US006227910B1

(12) United States Patent
Huang

(10) Patent No.: US 6,227,910 B1
(45) Date of Patent: May 8, 2001

(54) EMI SHIELD

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/244,329

(22) Filed: Feb. 3, 1999

(51) Int. Cl.[7] ..... H01R 9/03
(52) U.S. Cl. ..... 439/610; 439/607
(58) Field of Search ..... 439/610, 609

(56) References Cited

U.S. PATENT DOCUMENTS 4,653,836 * 3/1987 Peele ..... 439/610
4,689,723 * 8/1987 Myers et al. ..... 361/818
5,055,070 * 10/1991 Plegge et al. ..... 439/609
5,358,428 * 10/1994 Bixler et al. ..... 439/607
5,518,421 * 5/1996 Davis ..... 439/607

* cited by examiner

*Primary Examiner*—Brian Sircus
*Assistant Examiner*—Brian S. Webb
(74) *Attorney, Agent, or Firm*—Wei Te Chung

(57) ABSTRACT

An EMI shield in accordance with the present invention comprises a base section having a planar wall. End tabs upwardly extend from opposite ends of the planar wall and each tab defines a window for engaging with a wedge of a carrier of a connector core. A shroud section is assembled to the base section. Interengaging means is arranged between the base and shroud sections for assembling the shroud section to the base section. The interengaging means includes at least a latch formed on one of the shroud and base sections. At least a clip is formed on another of the shroud and base sections.

4 Claims, 8 Drawing Sheets

EMI SHIELD

FIELD OF THE INVENTION

The present invention relates to an EMI shield, and more particularly to an EMI shield which can be easily assembled to a connector while providing enhanced shielding capabilities thereto.

DESCRIPTION OF PRIOR ART

As the speed of signal transmission through a cable assembly increases, the need to isolate and protect signals from electrical noise becomes important. One existing method of achieving this is by using an EMI shield assembled to a housing of a connector.

An EMI shield is typically assembled to outer walls of a housing. Assembling the EMI shield to inner walls of the housing is another alternative. In some applications, such as an offset ultra SCSI connector, the EMI shield is molded with a connector core by an over-molding process. During the over-molding process, the flow of molten plastic may cause conductive wires to become easily disengaged from insulation displacement sections resulting in electrical disconnection therebetween. U.S. Pat. No. 5,766,033 issued to Davis on Jun. 16, 1998 discloses an electrical connector having insulation displacement sections on a common side. A pair of termination covers having latching arms is assembled to a housing of the connector. However, engagement between the latching arms and the housing can not sustain the pressure from the flow of molten plastic. When the termination covers are loosened, connections between conductive wires and insulation displacement sections become vulnerable to disengagement. A shell member includes a shroud and an integrally formed base. The asymmetric arrangement of the components complicates formation of the shell member.

Referring to FIG. 1A, a shroud 90 is drawn through a central portion of a metal sheet 9. After the shroud 90 is drawn, a left portion 91 of the metal sheet 9 is cut off (FIG. 1B) and a right portion 92 is used to form a base. Manufacturing costs are increased due to the excess waste produced by the left section 91. However, if a shroud 90A is drawn from a metal sheet 9A having the left section 91A cut off therefrom in advance, as shown in FIG. 1C, formation of the shroud 90A becomes difficult because the left section 91A is too small to be effectively retained by a fixture. Furthermore, the left section 91A will be deformed during the formation process since the material is drawn therefrom.

A shroud of limited thickness facilitates mating with a complementary shroud of a plug connector. However, a thick base facilitates EMI shielding. If the metal sheet is relatively thick, formation of the shroud becomes difficult and burrs are easily formed on an edge 94 of the shroud 90 (FIG. 1D) when an opening is formed therein. In addition, if the shroud 90 is too rigid, insertion of the complementary plug becomes difficult. If the metal sheet is relatively thin, EMI shielding will be inadequate. If the shroud 90 can be made from a thin metal sheet and the base can be made from a relatively thicker metal sheet, the manufacturing process will be simplified and the shielding effectiveness thereof will be enhanced.

SUMMARY OF THE INVENTION

An objective of the present invention is to provide an EMI shield having individually manufactured shroud and bottom sections.

In order to achieve the objective set forth, an EMI shield in accordance with the present invention comprises a base section having a planar wall. End tabs upwardly extend from opposite ends of the planar wall and each tab defines a window for engaging with a wedge of a carrier of a connector core. A shroud section is assembled to the base section. Interengaging means is arranged between the base and shroud sections for assembling the shroud section to the base section. The interengaging means includes at least a latch formed on one of the shroud and base sections. At least a clip is formed on another of the shroud and base sections.

These and additional objects, features, and advantages of the present invention will become apparent after reading the following detailed description of the preferred embodiment of the invention taken in conjunction with the appended drawing.

DETAILED DESCRIPTION OF THE PREFERRED EMBODIMENT

Figure 1B:
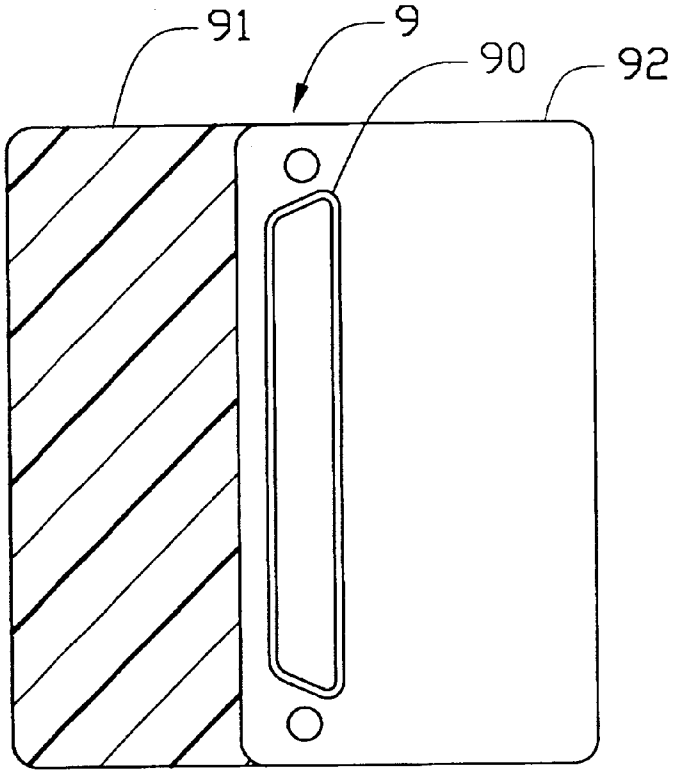
FIG. 1B (PRIOR ART)
FIG. 1B is similar to FIG. 1A with a left section cut off therefrom (marked in dotted lines)
Figure 1A:
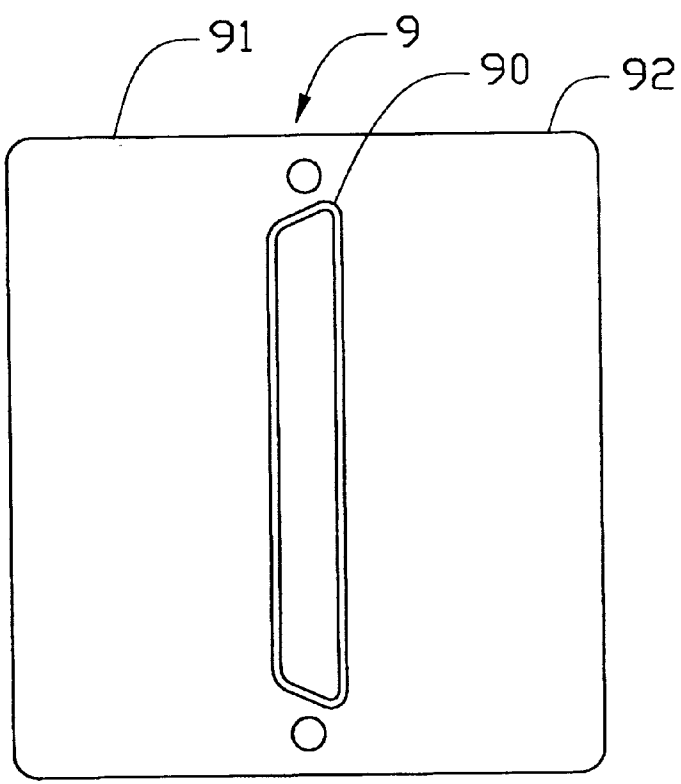
FIG. 1A (PRIOR ART)
FIG. 1A is a schematic view of a metal sheet with a shroud formed in a central portion thereof in accordance with the prior art.
Figure 1D:
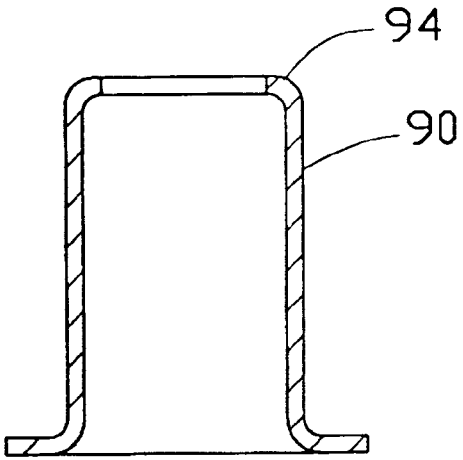
FIG. 1D is a cross sectional view of a shroud in accordance with the prior art.
Figure 1C:
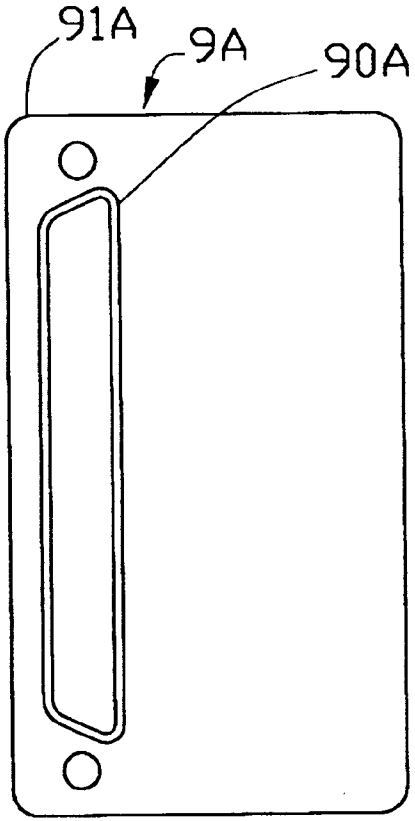
FIG. 1C is a schematic view of a metal sheet with a smaller left section in accordance with the prior art.
Figure 2A:
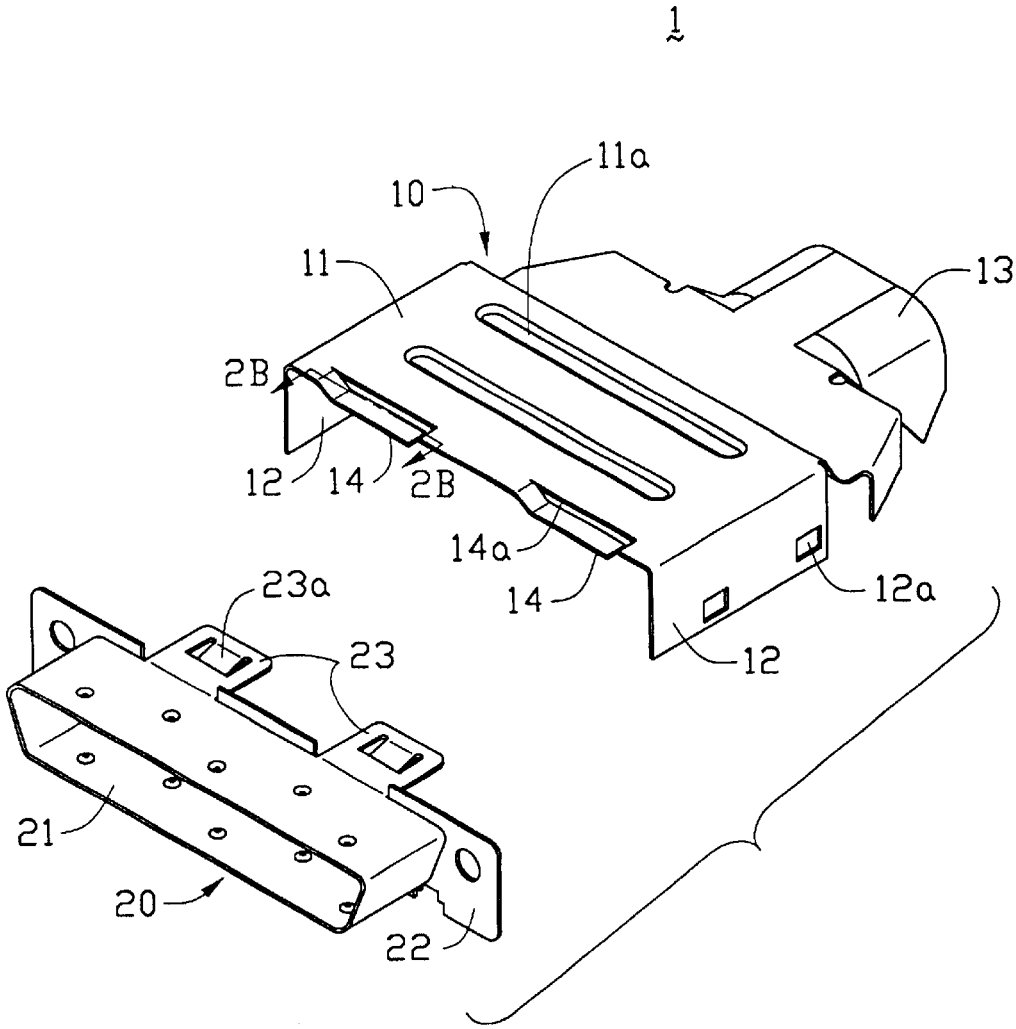
FIG. 2A is a perspective view of a disassembled EMI shield in accordance with a first embodiment of the present invention.
Figure 2B:
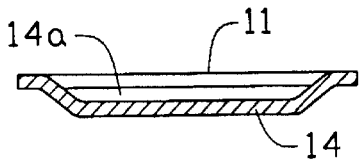
FIG. 2B is an enlarged cross sectional view of a latch taken along line 2B—2B of FIG. 2A.
Figure 6:
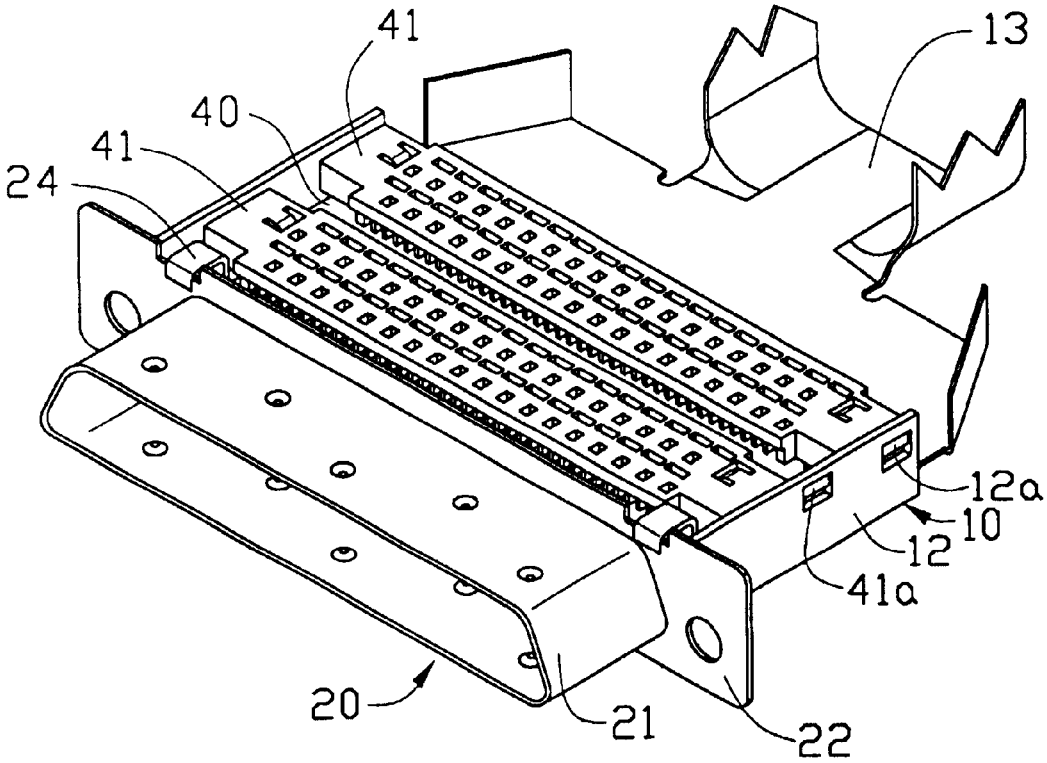
FIG. 6 is a perspective view showing a connector core assembled in the EMI shield.
Figure 7:
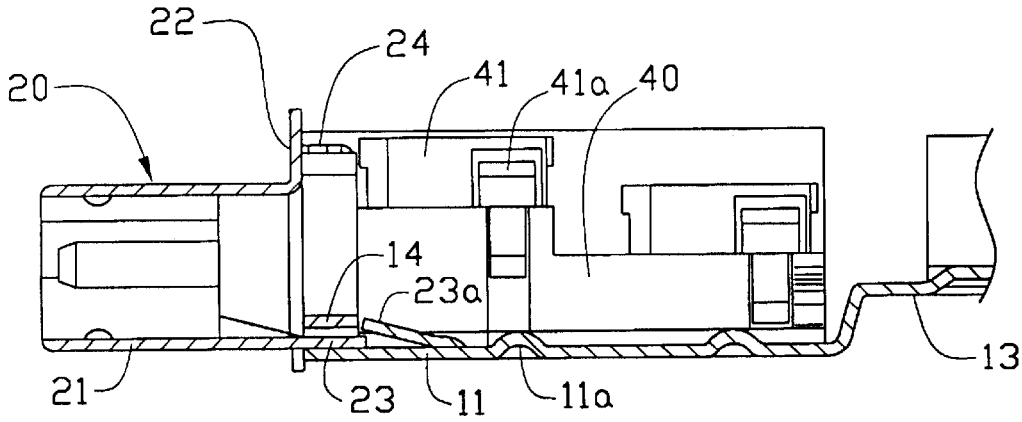
FIG. 7 is a cross sectional view of FIG. 6.

Referring to FIGS. 2A, 3, 4A and 4B, an EMI shield 1 in accordance with the present invention comprises a base section 10 and a shroud section 20 fixedly assembled to the base section 10. The base section 10 includes a planar wall 11 providing a connector core 40 with EMI shielding capabilities when the base section 10 is assembled thereto. End tabs 12 upwardly extend from opposite ends thereof. Each tab 12 defines a pair of windows 12*a* for engaging with wedges 41*a* of carriers 41 of the connector core 40 (FIG. 6). A strain relief 13 rearwardly extends from the base section 10. The base section 10 is made from a metal sheet having a thickness which provides excellent EMI shielding capabilities when the base section 10 is assembled to a bottom face of the connector core 40. The base section 10 further forms reinforced ribs 11*a* extending longitudinally for increasing the rigidity of the base section 10. A pair of latches 14 is formed on a front edge of the base section 10. As clearly shown in FIG. 2B, a passage 14*a* is defined between the latch 14 and the planar wall 11.

Figure 4A:
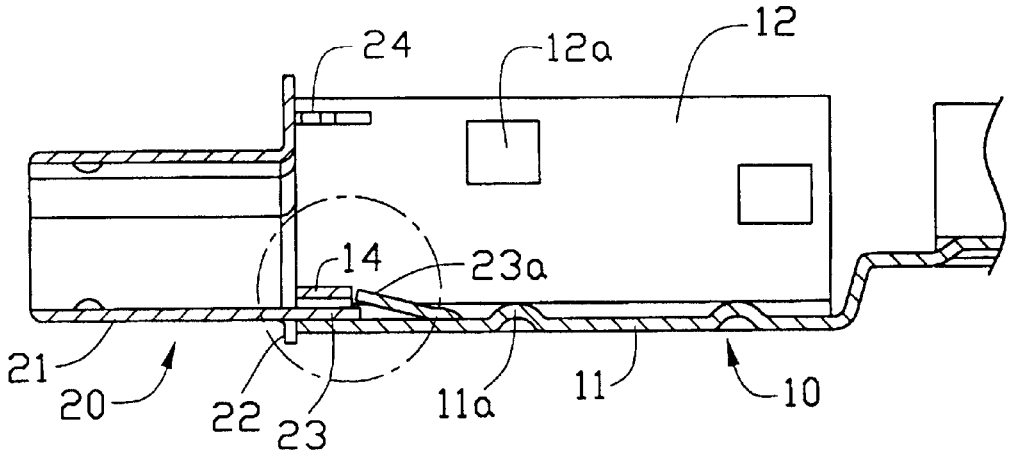
FIG. 4A is a cross sectional view of the assembled EMI shield.
Figure 4B:
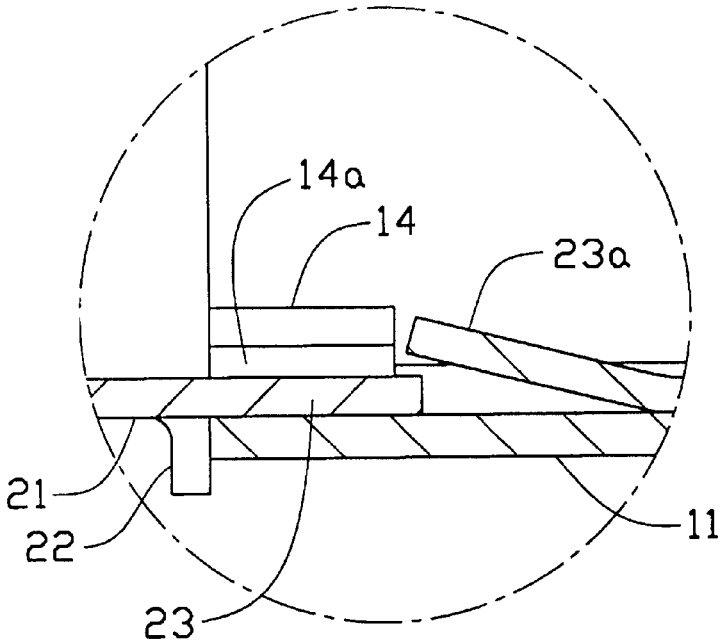
FIG. 4B is an enlarged view of an encircled portion of FIG. 4A.
Figure 5C:
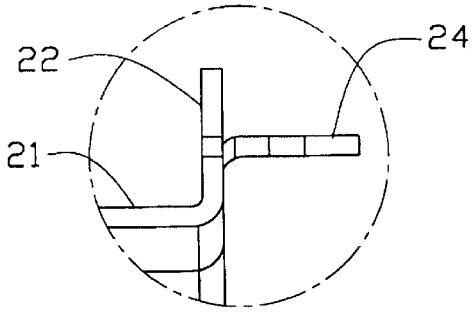
FIG. 5C is a partially enlarged view of FIG. 5A
Figure 5D:
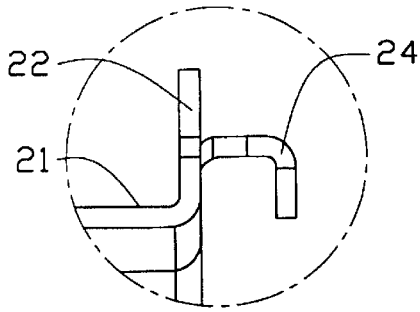
FIG. 5D is a partially enlarged view of FIG. 5B
Figure 5A:
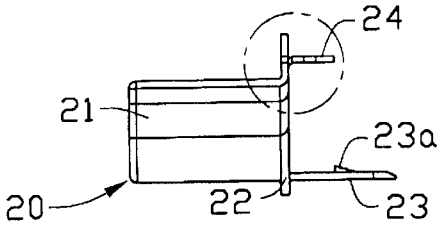
FIG. 5A is an enlarged view of a retaining tab before riveting.
Figure 5B:
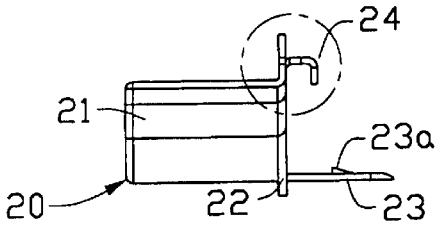
FIG. 5B is similar to FIG. 5A showing the retaining tab after riveting.

The shroud section 20 includes a shroud 21 and a flange 22 transversally extending from a bottom peripheral edge of the shroud 21. The shroud section 20 includes a pair of clips 23 rearwardly extending from the bottom peripheral edge thereof. Each clip 23 forms a ratchet 23*a* extending forwardly and upwardly therefrom. The clips 23 extend through the passages 14*a* when the shroud section 20 is assembled to the base section 10. The height of the ratchet 23*a* is larger than the width of the passage 14*a*, thus, when the clip 23 is inserted through the passage 14*a*, the ratchet 23*a* is deformed and then resumes its original shape after the ratchet 23*a* slides over the latch 14. When the ratchet 23*a* abuts against a rear face of the latch 14 and the flange 22 abuts against the front edge of the base section 10, the shroud section 20 is fixedly assembled to the base section 10 (FIGS. 4A and 4B).

According to the present invention, the shroud section 20 is made separately from the base section 10. In order to provide excellent flexibility, the shroud section 20 is made from a metal sheet having a thinner thickness than the metal sheet from which the base section 10 is made thereby facilitating engagement with a complementary plug connector (not shown). By this arrangement, problems arising from the prior art design are effectively eliminated.

Figure 3:
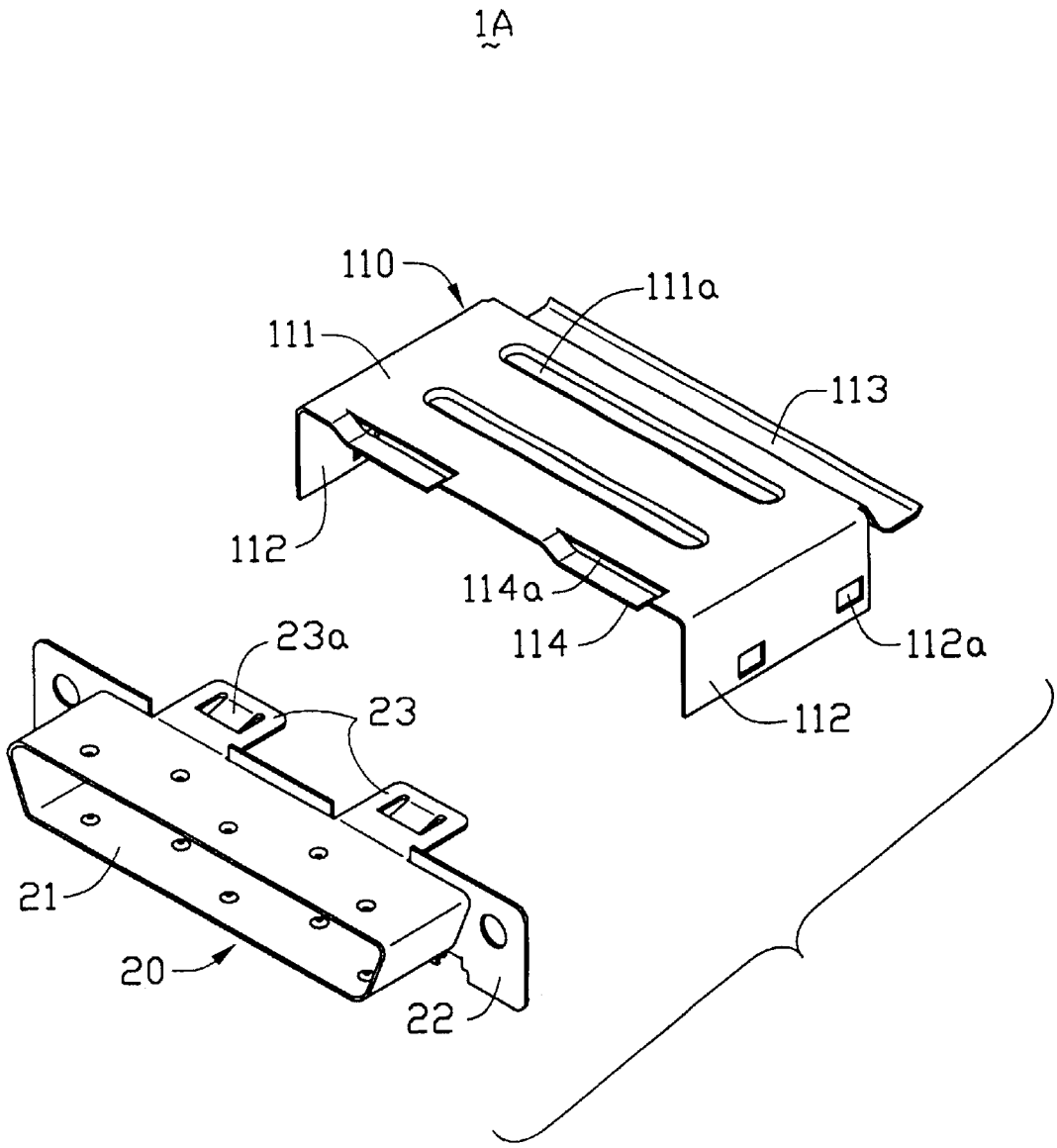
FIG. 3 is a perspective view of a disassembled EMI shield in accordance with a second embodiment of the present invention.

FIG. 3 discloses an EMI shield 1A in accordance with a second embodiment of the present invention. The EMI shield 1A includes a base section 110 and a shroud section 20. The base section 110 is almost identical to the base section 10 of the first embodiment except the strain relief 13 is omitted. The base section 110 includes a tail 113 which abuts against a rear wall of the connector core 40 and a planar wall 111. End tabs 112 upwardly extend from opposite ends of the planar wall 111. Each tab 112 defines a pair of windows 112*a* for engaging with the wedges 41*a* of the carriers 41 of the connector core 40 (FIG. 6). The base section 110 further forms reinforced ribs 111*a* extending longitudinally to increase the rigidity thereof. A pair of latches 114 is formed on a front edge thereof. A passage 114*a* is defined between each latch 114 and the planar wall 111.

Referring to FIGS. 5A, 5B, 5C, 5D, 6 and 7, the shroud section 20 further includes a pair of tabs 24 extending from the flange 22. The tabs 24 can be riveted to engage with the connector core 40. By this arrangement, the shroud section 20 is fixedly assembled to the connector core 40.

It is noted that the securement between the base section 10 and the shroud section 20 is positioned along the elongated edge of the planar wall 11, thus efficiently securing the shroud section 20 to the base section 10. It is also noted that because the base section 10 requires no drawing process to form any shroud portion thereof, the base section 10 can be made of thicker and stiffer material for better shielding and protection consideration. In opposite, the shroud section 20 can be made of thinner and more flexible material for compliance with the drawing process of the shroud and for facilitating adjustably engaging the complementary plug connector.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An EMI shield for an electrical connector, comprising:

a base section having a planar wall and end tabs upwardly extending from opposite ends of the wall, each tab defining a window for engaging with a wedge of said electrical connector;

a shroud section assembled to said base section, said shroud section including a shroud and a flange extending transversally from a peripheral edge of said shroud; and interengaging means arranged between said base section and said shroud section for assembling said shroud section to said base section;

wherein said interengaging means comprises a latch formed on a front edge of said base section with a passage defined between the latch and the planar wall and a clip formed on said shroud section with a ratchet forwardly and obliguely extending therefrom;

wherein the clip extends throug the passage with the ratchet abutting against the latch for preventing disassembling between the base section and the shroud section.

2. The EMI shield as recited in claim 1, wherein said clip extends from the peripheral edge of said shroud.

3. An electrical assembly comprising:

a connector core;

an EMI shield including:

a base section supportably attachably receiving said connector core therein; and a shroud section assembled to said base and defining a flange and a shroud extending therefrom, wherein said base section is made from a thicker and stiffer metal sheet while said shroud section is made from a thinner and more flexible metal sheets;

a latch formed on a front edge of said base section with a passage formed between the latch and a planar wall of said base section;

a clip formed on the shroud section with a ratchet forwardly and obliguely extending therefrom; wherein said clip extends through said passage with the ratchet abutting against the latch for preventing dissembling between the base section and the shroud section.

4. An electrical assembly comprising:

a connector core;

an EMI shield including:

a base section supportably attachably receiving said connector core therein;

a shroud section assembled to said base section and defining a flange and a shroud extending therefrom;

first means for combining the base section with the shroud section; and second means for combining the shroud section with the connector core;

wherein said first means and said second means are respectively positioned on two opposite sides of the flange; wherein said first means includes a clip on the shroud section and said second means includes a tab on the shroud section under a condition that said clip extends rearwardly farther than the tab and beyond the connector core to engage the base section while the tab terminates at a rear portion of the connector core.

* * * * *